US011035071B2

(12) United States Patent
Damtew

(10) Patent No.: US 11,035,071 B2
(45) Date of Patent: Jun. 15, 2021

(54) METHOD FOR DRAIN STANDPIPE HEIGHT DETECTION

(71) Applicant: Haier US Appliance Solutions, Inc., Wilmington, DE (US)

(72) Inventor: Fikreadam Abebe Damtew, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 109 days.

(21) Appl. No.: 16/238,608

(22) Filed: Jan. 3, 2019

(65) Prior Publication Data

US 2020/0217002 A1 Jul. 9, 2020

(51) Int. Cl.
*D06F 39/08* (2006.01)
*D06F 33/47* (2020.01)

(52) U.S. Cl.
CPC ..... *D06F 39/085* (2013.01); *D06F 33/47* (2020.02)

(58) Field of Classification Search
CPC ..... D06F 33/00; D06F 33/30–76
See application file for complete search history.

(56) References Cited

U.S. PATENT DOCUMENTS

| | | | | |
|---|---|---|---|---|
| 4,418,712 | A | 12/1983 | Braley | |
| 7,810,362 | B2 | 10/2010 | Harwood et al. | |
| 2007/0113595 | A1* | 5/2007 | Harwood | D06F 35/00 68/12.01 |
| 2017/0302208 | A1* | 10/2017 | Je | D06F 39/085 |
| 2020/0063325 | A1* | 2/2020 | Billa | D06F 39/087 |

* cited by examiner

*Primary Examiner* — Michael E Barr
*Assistant Examiner* — Omair Chaudhri
(74) *Attorney, Agent, or Firm* — Dority & Manning, P.A.

(57) ABSTRACT

A method for detecting drain standpipe height in a washing machine appliance includes activating a drain pump such that the drain pump flows wash fluid from a tub to a drain standpipe, determining a height of the drain standpipe, and adjusting operation of the washing machine appliance in response to the determined height of the drain standpipe.

9 Claims, 4 Drawing Sheets

METHOD FOR DRAIN STANDPIPE HEIGHT DETECTION

FIELD OF THE INVENTION

The present subject matter relates generally to methods for detecting drain standpipe height in washing machine appliances.

BACKGROUND OF THE INVENTION

Washing machine appliances include a pump that drains wash fluid from within a tub. The pump flows the wash fluid to a drain standpipe that is a component of a building housing the washing machine appliance. A height of the drain standpipe varies between buildings. The height of the drain standpipe is normally about three feet (3'). However, in certain buildings, the height of the drain standpipe can be eight feet (8') or more.

High drain standpipes pose challenges. For example, washing machine appliances are frequently programmed to run the drain pump for a predetermined period of time that is selected to fully drain the tub under normal conditions. However, in buildings with high drain standpipes, the drain pump can require more time to fully drain the tub. If the drain pump does not have sufficient time or capacity to fully drain the tub, then wash water can remain with a sump of the tub. Such wash water can negatively affect rotation of a basket within the tub and/or generate an undesirable soap sud condition within the tub.

BRIEF DESCRIPTION OF THE INVENTION

Aspects and advantages of the invention will be set forth in part in the following description, or may be apparent from the description, or may be learned through practice of the invention.

In a first example embodiment, a method for detecting drain standpipe height in a washing machine appliance includes activating a drain pump such that the drain pump flows wash fluid from a tub to a drain standpipe, receiving a signal from a pressure sensor associated with the tub while the drain pump flows the wash fluid from the tub to the drain standpipe, determining a height of the drain standpipe based on the signal from the pressure sensor, and adjusting operation of the washing machine appliance in response to the determined height of the drain standpipe.

In a second example embodiment, a washing machine appliance includes a tub and a basket within the tub. A motor is coupled to the basket. The motor is operable to rotate the basket within the tub. A drain pump is operable to flow wash fluid from the tub. A pressure sensor is in fluid communication with the tub. A signal from the pressure sensor is variable as a function of wash fluid height within the tub. A controller is in operative communication with the motor, the drain pump and the pressure sensor. The controller is configured to activate the drain pump such that the drain pump flows the wash fluid from the tub to a drain standpipe, receive the signal from the pressure sensor while the drain pump flows the wash fluid from the tub to the drain standpipe, determine a height of the drain standpipe based on the signal from the pressure sensor, and adjust operation of the washing machine appliance in response to the determined height of the drain standpipe.

In a third example embodiment, a method for detecting drain standpipe height in a washing machine appliance includes activating a drain pump such that the drain pump flows wash fluid from a tub to a drain standpipe, measuring one or both of a current through the drain pump and a power consumption of the drain pump while the drain pump flows the wash fluid from the tub to the drain standpipe, determining a height of the drain standpipe based on the measured one or both of the current through the drain pump and the power consumption of the drain pump, and adjusting operation of the washing machine appliance in response to the determined height of the drain standpipe.

In a fourth example embodiment, a washing machine appliance includes a tub and a basket within the tub. A motor is coupled to the basket. The motor is operable to rotate the basket within the tub. A drain pump is operable to flow wash fluid from the tub. A controller is in operative communication with the motor and the drain pump. The controller is configured to activate the drain pump such that the drain pump flows the wash fluid from the tub to a drain standpipe, measure one or both of a current through the drain pump and a power consumption of the drain pump while the drain pump flows the wash fluid from the tub to the drain standpipe, determine a height of the drain standpipe based on the measured one or both of the current through the drain pump and the power consumption of the drain pump, and adjust operation of the washing machine appliance in response to the determined height of the drain standpipe.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
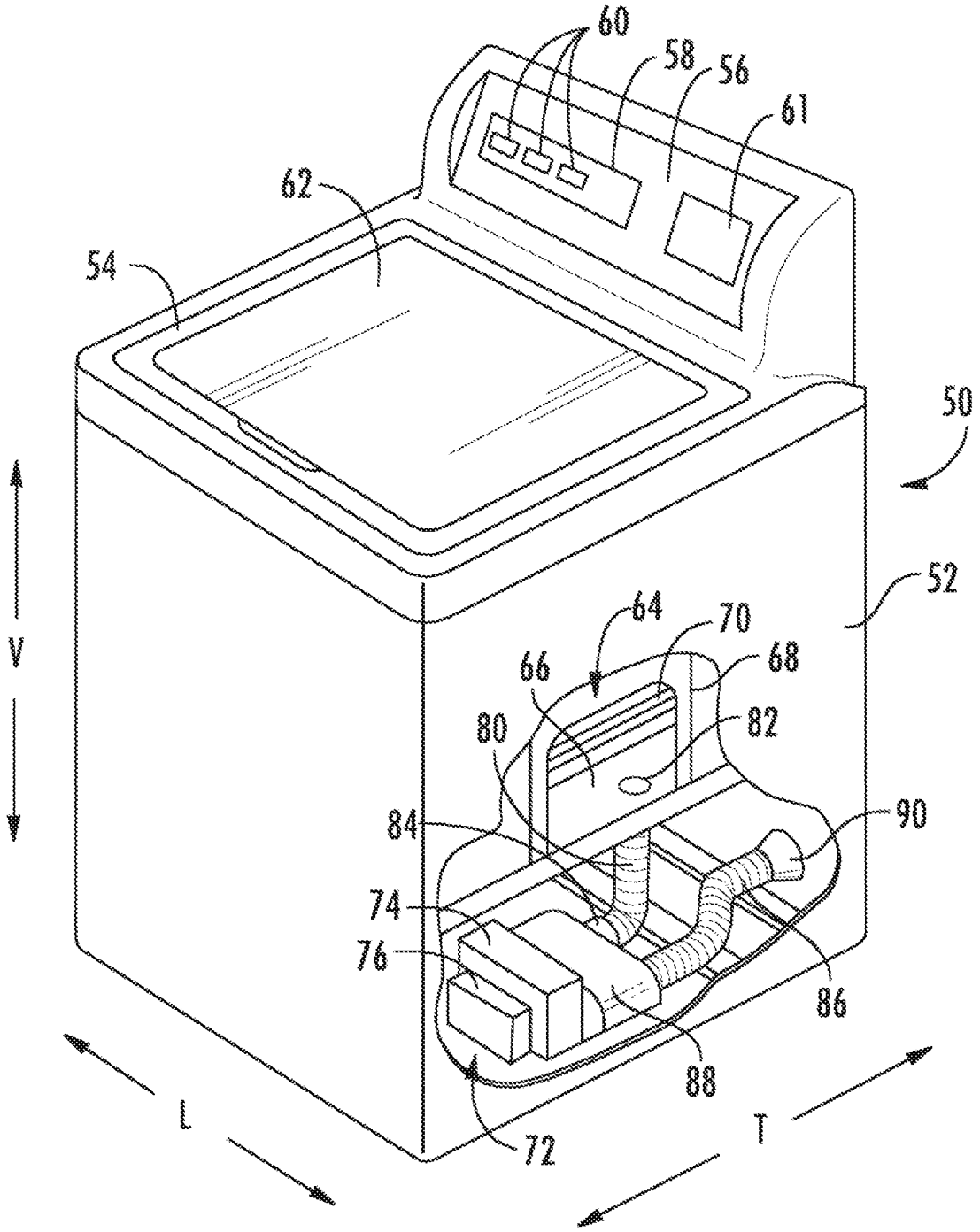
FIG. 1 is a perspective view of a washing machine appliance according an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an exemplary embodiment of the present subject matter. As may be seen in FIG. 1, washing machine appliance 50 defines a vertical direction V, a lateral direction L and a transverse direction T. The vertical direction V, lateral direction L and transverse direction T are mutually perpendicular and form an orthogonal direction system.

Washing machine appliance 50 includes a cabinet or apron 52 and a top panel or cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within apron 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

A sub-washer unit 65 (FIG. 2) is mounted within apron 52. Sub-washer unit 65 includes tub 64 and a basket 70. Tub 64 includes a bottom wall 66 and a cylindrical side wall 68, and basket 70 is rotatably mounted within wash tub 64. Bottom wall 66 of tub 64 is spaced, e.g., vertically, from an open top end of cylindrical side wall 68. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 3:
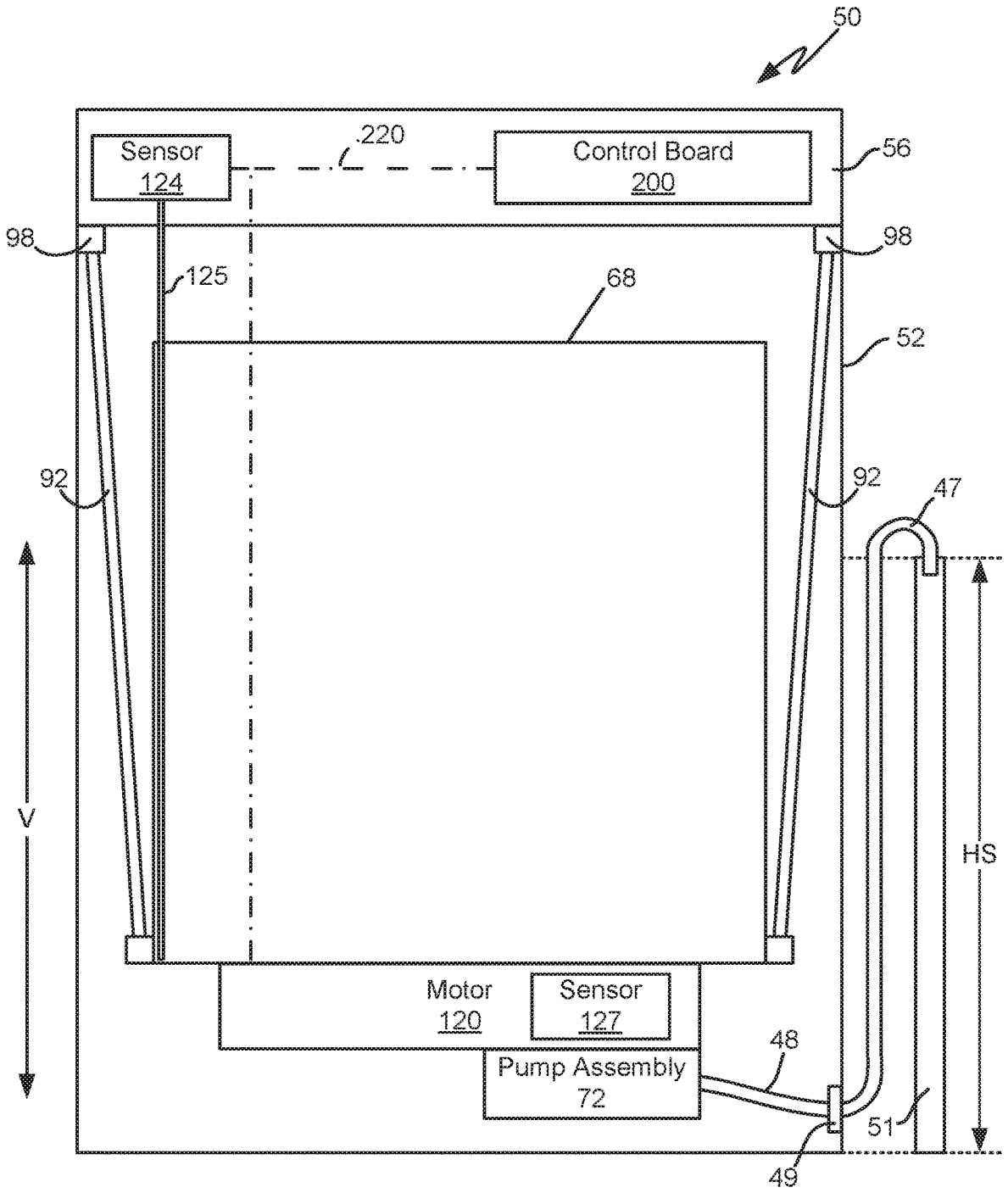
FIG. 3 is a schematic view of certain components of the example washing machine appliance of FIG. 1.

As shown in FIG. 3, pump assembly 72 may be mounted to tub 64 in alternative example embodiments. In particular, pump assembly 72 may be mounted directly to the bottom side of subwasher unit 65. Wash fluid may drain under gravity from tub 64 is pumped out of appliance 50 via pump assembly 72. The displaced wash fluid passes through a flexible bellows type hose 48, which has a discharge end attached to a rear panel mounted bracket 49, during operation of pump assembly 72.

Figure 2:
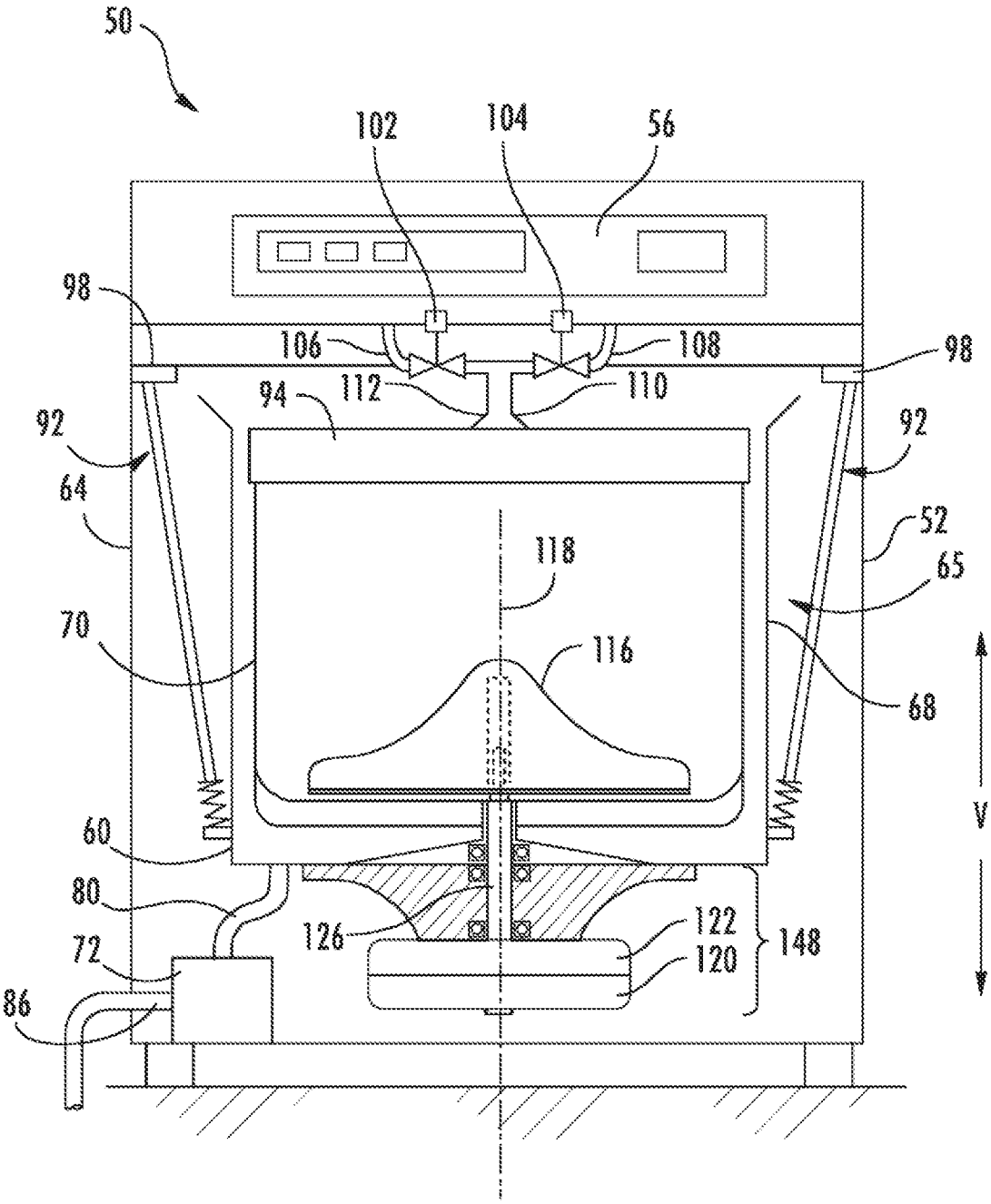
FIG. 2 is a section view of the example washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148 and may be a component of sub-washer unit 65.

Sub-washer unit 65 further includes a vibration damping suspension system or mount 92 for supporting sub-washer unit 65 within apron 52. One end of mount 92 may be connected to sub-washer unit 65 while an opposite end of mount 92 is receivable within and/or coupled to at least one bracket 98. Thus, mount 92 may extend between sub-washer unit 65 and bracket 98 in order to suspend sub-washer unit 65 within apron 52.

Mount 92 can include a plurality of damping elements, such as piston-cylinder damping elements, coupled to the wash tub 64. The damping suspension system 92 can include other elements, such as a balance ring 94 disposed around the upper circumferential surface of the wash basket 70. The balance ring 94 can be used to counterbalance an out of balance condition for the wash machine as the basket 70 rotates within the wash tub 64.

Operation of washing machine appliance 50 is controlled by a controller (not shown) which is operatively coupled to the user interface input located on washing machine backsplash 56 (shown in FIG. 1) for user manipulation to select washing machine cycles and features. In response to user manipulation of the user interface input, the controller operates the various components of washing machine appliance 50 to execute selected machine cycles and features.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise and counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed and portions of the cycle may be repeated, including the agitation phase, depending on the particulars of the wash cycle selected by a user.

FIG. 3 is schematic view of certain components of washing machine appliance 50. As may be seen in FIG. 3, washing machine appliance 50 includes a wash fluid height sensor 124, a controller or control board 200 and a wiring harness 220. Control board 200 is positioned within apron 52, e.g., within backsplash 56. Wiring harness 220 electrically connects control board 200 with one or more electrical components, such as motor 76, motor 120 and wash fluid height sensor 124. Thus, e.g., wiring harness 220 may extend between control board 200 and the one or more electrical components.

Control board 200 may include one or more processors and a memory. The processor(s) of control board 200 can be any suitable processing device, such as a microprocessor, microcontroller, integrated circuit, or other suitable processing device. The memory of control board 200 can include any suitable computing system or media, including, but not limited to, non-transitory computer-readable media, RAM, ROM, hard drives, flash drives, or other memory devices. The memory of control board 200 can store information accessible by the processor(s) of control board 200, including instructions that can be executed by the processor(s) to control various components of washing machine appliance 50 to provide appliance functionality and data. Thus, the combination of one or more processors and memory may correspond to a controller configured to implement various programs or methods to operate washing machine appliance 50. Input/output ("I/O") signals may be routed between control board 200 and various operational components of washing machine appliance 50, including the one or more electrical components, along wiring harness 220 within washing machine appliance 50. Wiring harnesses 220 may include a plurality of conductive wires.

Control board 200 may be configured for measuring one or both of a current through pump assembly 72 and a power consumption of pump assembly 72. For example, control board 200 may include a sensor 127, such as an ammeter, for measuring one or both of the current through pump assembly 72 and the power consumption of pump assembly 72. Thus, control board 200 may receive a signal from sensor 127 that corresponds to the one or both of the current through pump assembly 72 and the power consumption of pump assembly 72.

Wash fluid height sensor 124 is operable to measure the height of wash fluid within tub 68. For example, wash fluid height sensor 124 may be in fluid communication with tub 68 via a hose 125 that extends between tub 68 and wash fluid height sensor 124. A pressure of air within hose 125 may vary as a function of the height of wash fluid within tub 68, and wash fluid height sensor 124 may be configured for measuring the pressure of air within hose 125. Thus, wash fluid height sensor 124 may be a pressure sensor, and a signal from wash fluid height sensor 124 may vary as a function of the height of wash fluid within tub 68. Control board 200 may receive the signal from wash fluid height sensor 124 to establish the height of wash fluid within tub 68.

Washing machine appliance 50 may include a drain hose 47 that extends from rear panel mounted bracket 49. An end of drain hose 47 may be received within a drain standpipe 51. Thus, wash fluid from pump assembly 72 may flow through drain hose 47 into drain standpipe 51. Drain standpipe 51 is a component of a building housing washing machine appliance 50. Thus, a height HS of drain standpipe 51 may vary between buildings. The height HS of drain standpipe 51 may correspond to a vertical distance between a bottom of washing machine appliance 50 (e.g., or rear panel mounted bracket 49) and a top of drain standpipe 51 (e.g., at which drain hose 47 is inserted into drain standpipe 51).

Due to variations of the height HS of drain standpipe 51 between buildings, pump assembly 72 may have a different drain rate between buildings. For example, when washing machine appliance 50 is installed within a building in which the height HS of drain standpipe 51 is eight feet (8'), the drain rate of pump assembly 72 may be relatively low compared to when washing machine appliance 50 is installed within a building in which the height HS of drain standpipe 51 is three feet (3'). As discussed in greater detail below, washing machine appliance 50 includes features for determining the height HS of drain standpipe 51, e.g., and adjusting operation of washing machine appliance 50 to account for the determined height HS.

An example method for detecting drain standpipe heights in washing machine appliances will now be described. The control board 200 of washing machine appliance 50 may run the drain standpipe height detection method in order to ensure proper operation of washing machine appliance 50. The drain standpipe height detection method may advantageously allow operation of washing machine appliance 50 to account for various heights HS of drain standpipes 51 between buildings and allow suitable draining of tub 68 by pump assembly 72 despite the various heights HS of drain standpipes 51. It will be understood that while discussed below in a certain sequence, the drain standpipe height detection method may be performed in other suitable sequences in alternative example embodiments. Thus, the drain standpipe height detection method is not limited to the particular sequence described below.

Initially, pump assembly 72 may be activated such that pump assembly 72 flows wash fluid from tub 68 to drain standpipe 51. In particular, control board 200 may power motor 76 to drive pump 74 within pump assembly 72. Pump 74 may urge wash fluid from tub 68 out of washing machine appliance 50 to drain standpipe 51. In particular, pump 74 may flow the wash fluid from tub 68 up the height HS of drain standpipe 51 during operation of pump assembly 72. While pump assembly 72 is activated and flowing wash fluid from tub 68 to drain standpipe 51, the drain standpipe height detection method may detect the height HS of drain standpipe 51 using various mechanisms.

Figure 4:
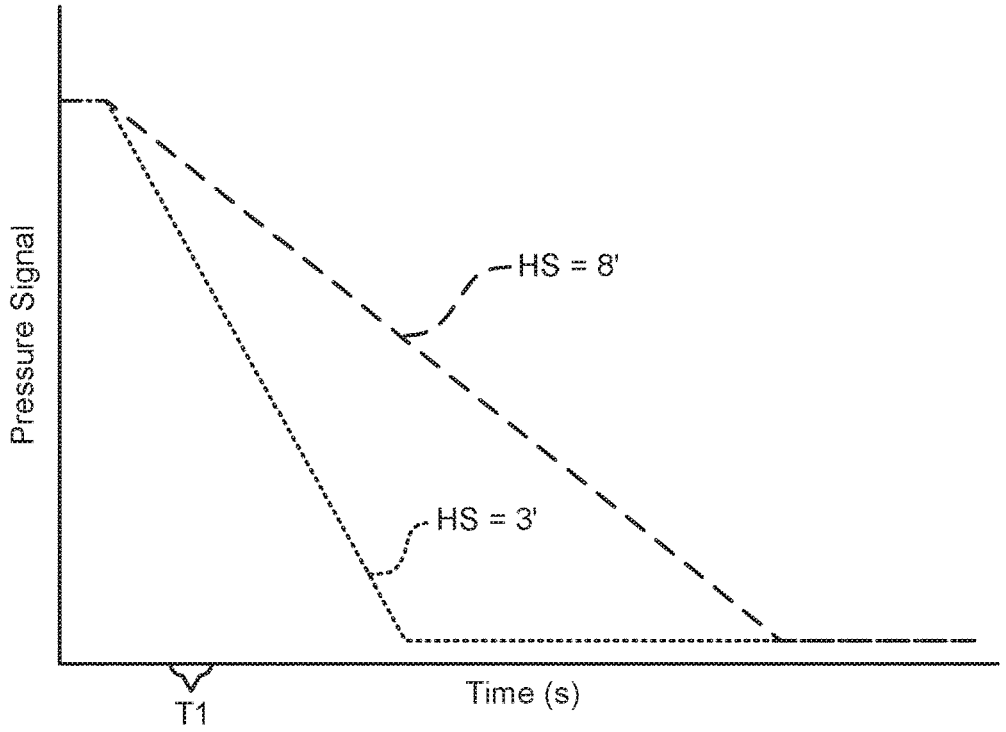
FIG. 4 is a plot of a pressure signal versus time during a drain standpipe height detection method according to an example embodiment of the present subject matter.

As a first example, with reference to FIG. 4, wash fluid height sensor 124 tracks the height of wash fluid within tub 68 while pump assembly 72 flows wash fluid from tub 68 to drain standpipe 51. As noted above, wash fluid height sensor 124 may be a pressure sensor such that the signal from wash fluid height sensor 124 to control board 200 varies as a function of the height of wash fluid within tub 68. Thus, control board 200 may track the height of wash fluid within tub 68 with the signal from wash fluid height sensor 124.

The height HS of drain standpipe 51 may be determined based on the signal from wash fluid height sensor 124. As an example, the height HS of drain standpipe 51 may be determined by calculating a rate of change in the signal from wash fluid height sensor 124 over time while pump assembly 72 flows wash fluid from tub 68 to drain standpipe 51. The height HS of drain standpipe 51 may be proportional to the rate of change in the signal from wash fluid height sensor 124 while pump assembly 72 flows wash fluid from tub 68 to drain standpipe 51.

As shown in FIG. 4, a magnitude of the rate of change in the signal from wash fluid height sensor 124 when the height HS of drain standpipe 51 is three feet (3') may be greater than the magnitude of the rate of change in the signal from wash fluid height sensor 124 when the height HS of drain standpipe 51 is eight feet (8'). A drain standpipe height of three feet (3') may correspond to a normal drain standpipe height, and drain standpipe heights significantly greater than three feet (3'), e.g., two more feet greater, may correspond to high drain standpipe heights. Thus, the magnitude of the rate of change in the signal from wash fluid height sensor 124 may be relatively high when the height HS of drain standpipe 51 is normal, and the magnitude of the rate of change in the signal from wash fluid height sensor 124 may be relatively low when the height HS of drain standpipe 51 is greater than normal. As may be seen from the above, e.g., pump assembly 72 may have a normal drain rate when the height HS of drain standpipe 51 is normal (e.g., when the magnitude of the rate of change in the signal from wash fluid height sensor 124 over time is greater than a threshold value). Conversely, pump assembly 72 may have a low drain rate when the height HS of drain standpipe 51 is greater than normal (e.g., when the magnitude of the rate of change in the signal from wash fluid height sensor 124 over time is less than the threshold value).

The rate of change may be determined during a time interval T1 after activating pump assembly 72 to flow wash fluid from tub 68 to drain standpipe 51. The time interval T1 may be any suitable duration, e.g., three seconds (3 s), five seconds (5 s), ten seconds (10 s), etc. Such durations may provide suitable data from wash fluid height sensor 124 to account for noise in the signal from wash fluid height sensor 124. The time interval T1 may also begin at any suitable time after activating pump assembly 72, e.g., ten seconds (10 s), twenty seconds (20 s), thirty seconds (30 s), etc. after activating pump assembly 72. Such delay may provide sufficient time for pump assembly 72 to begin steadily pumping wash fluid from tub 68 to drain standpipe 51.

Figure 5:
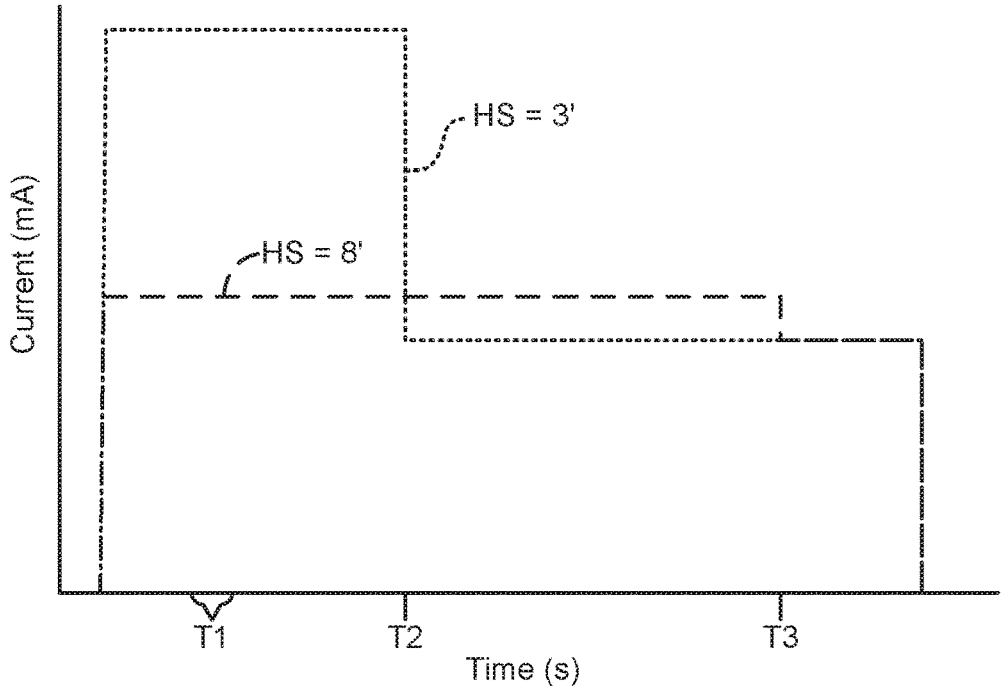
FIG. 5 is a plot of a current versus time during a drain standpipe height detection method according to an example embodiment of the present subject matter.

As a second example, with reference to FIG. 5, control board 200 may measure one or both of the current through pump assembly 72 and the power consumption of pump assembly 72, e.g., with sensor 127, while pump assembly 72 flows wash fluid from tub 68 to drain standpipe 51. The height HS of drain standpipe 51 may be determined based on one or both of the current through pump assembly 72 and the power consumption of pump assembly 72. As an example, the height HS of drain standpipe 51 may be proportional to one or both of the current through pump assembly 72 and the power consumption of pump assembly 72 while pump assembly 72 flows wash fluid from tub 68 to drain standpipe 51. Thus, control board 200 may track one or both of the current through pump assembly 72 and the power consumption of pump assembly 72 while pump assembly 72 flows wash fluid from tub 68 to drain standpipe 51.

As shown in FIG. 5, a magnitude of the current through pump assembly 72 when the height HS of drain standpipe 51 is three feet (3') may be greater than the magnitude of the current through pump assembly 72 when the height HS of drain standpipe 51 is eight feet (8'). As noted above, a drain standpipe height of three feet (3') may correspond to a normal drain standpipe height, and drain standpipe heights significantly greater than three feet (3'), e.g., two more feet greater, may correspond to high drain standpipe heights. Thus, the magnitude of the current through pump assembly 72 may be relatively high when the height HS of drain standpipe 51 is normal, and the magnitude of the current through pump assembly 72 may be relatively low when the height HS of drain standpipe 51 is greater than normal. As may be seen from the above, e.g., pump assembly 72 may have a normal drain rate when the height HS of drain standpipe 51 is normal (e.g., when the magnitude of the current through pump assembly 72 is greater than a threshold value). Conversely, pump assembly 72 may have a low drain rate when the height HS of drain standpipe 51 is greater than normal (e.g., when the magnitude of the current through pump assembly 72 is less than the threshold value). While only the current through pump assembly 72 is shown in FIG. 5, it will be understood that the power consumption of pump assembly 72 may behave in the same manner as that described above for the current through pump assembly 72.

The average magnitude of the current through pump assembly 72 (and/or the power consumption of pump assembly 72) may be determined during the time interval T1 after activating pump assembly 72 to flow wash fluid from tub 68 to drain standpipe 51, e.g., in the manner described above in the context of FIG. 4. As shown in FIG. 5, the current through pump assembly 72 may also significantly decrease after the time interval T1, e.g., when pump assembly 72 fully drains tub 68 and draws air. As shown in FIG. 5, the current through pump assembly 72 may significantly decrease at a time T2 after activating pump assembly 72 to flow wash fluid from tub 68 to drain standpipe 51 when the height HS of drain standpipe 51 is three feet (3'). Conversely, the current through pump assembly 72 may significantly decrease at a time T3 after activating pump assembly 72 to flow wash fluid from tub 68 to drain standpipe 51 when the height HS of drain standpipe 51 is eight feet (8'). The time T3 is later than the time T2 when tub 68 holds the same volume of wash fluid due to the increased height HS of drain standpipe 51.

After determining the height HS of drain standpipe 51, operation of washing machine appliance 50 is adjusted in response to the determined height HS of drain standpipe 51. As an example, control board 200 may be configured to adjust operation of washing machine appliance 50 by one or more of modifying a drain profile of pump assembly 72, modifying a spin profile of basket 70 during a spin cycle, and modifying a rinse profile during a rinse cycle when the height HS of drain standpipe 51 is the low drain rate. In particular, control board 200 may be configured to extending the spin cycle, decreasing a rotational speed and/or acceleration of basket 70 during the spin cycle, and/or conducting an additional rinse cycle or a different rinse cycle, such as a warm rinse or a deep rinse, in response to the determined height HS of drain standpipe 51. In particular, when the height HS of drain standpipe 51 is greater than a normal drain standpipe height (e.g., and pump assembly 72 takes longer to drain tub 68), control board 200 may adjust operation of washing machine appliance 50 by one or more of modifying the drain profile of pump assembly 72, modifying the spin profile of basket 70 during the spin cycle, and modifying the rinse profile during the rinse cycle to allow additional draining of tub 68 and/or prevent excessive soap sud formation within tub 68.

The drain standpipe height detection method described above may assist with sensing the height HS of drain standpipe 51. The sensed height HS of drain standpipe 51 may advantageously allow customization of cycle parameters based on installation specifics of washing machine appliance 50.

In certain example embodiments, the height HS of drain standpipe 51 may be saved within the memory of control board 200. When the height HS of drain standpipe 51 is saved within the memory of control board 200, a wash cycle may be modified for subsequent wash cycles in the following manner, e.g., to minimize soap sud formation within tub 68. As an example, detergent dosing may be modified when washing machine appliance 50 is equipped with a bulk dispense system. To compensate for the reduced detergent dose, washing machine appliance 50 may modify the wash cycle by extending agitation/tumbling duration, and/or by increasing wash fluid temperature. As another example, washing machine appliance 50 may add additional water into tub 68 during the wash agitation/tumbling phase to dilute the wash fluid prior to the drain cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for detecting drain standpipe height in a washing machine appliance, comprising:

activating a drain pump such that the drain pump flows wash fluid from a tub to a drain standpipe;

receiving a signal from a pressure sensor associated with the tub while the drain pump flows the wash fluid from the tub to the drain standpipe;

determining a height of the drain standpipe based on the signal from the pressure sensor by calculating a rate of change in the signal from the pressure sensor over time while the drain pump flows the wash fluid from the tub to the drain standpipe; and adjusting operation of the washing machine appliance to reduce soap sud formation within the tub in response to the determined height of the drain standpipe, and wherein adjusting the operation of washing machine appliance to reduce soap sud formation within the tub by one or more of modifying detergent dosing of a bulk dispense system, extending a duration of an agitation cycle, extending a duration of an tumbling cycle, adjusting a temperature of the wash fluid within the tub, adding additional wash fluid into the tub, modifying a rotational speed and/or acceleration of the basket during a spin cycle, and conducting an additional rinse cycle.

2. The method of claim 1, wherein the determined height of the drain standpipe is proportional to the rate of change in the signal from the pressure sensor over time while the drain pump flows the wash fluid from the tub to the drain standpipe.

3. The method of claim 1, wherein the determined height of the drain standpipe is a normal drain height when a magnitude of the rate of change in the signal from the pressure sensor over time is greater than a threshold value, and the determined height of the drain standpipe is a high drain height when the magnitude of the rate of change in the signal from the pressure sensor over time is less than the threshold value.

4. The method of claim 3, wherein adjusting operation of the washing machine appliance comprises one or more of modifying a drain profile of the drain pump, modifying a spin profile of a basket within the tub during a spin cycle, and modifying a rinse profile during a rinse cycle when the determined height of the drain standpipe is the high drain height.

5. A washing machine appliance, comprising:

a tub;

a basket within the tub;

a motor coupled to the basket, the motor operable to rotate the basket within the tub;

a drain pump operable to flow wash fluid from the tub;

a pressure sensor in fluid communication with the tub, a signal from the pressure sensor variable as a function of wash fluid height within the tub;

a controller in operative communication with the motor, the drain pump and the pressure sensor, the controller configured to activate the drain pump such that the drain pump flows the wash fluid from the tub to a drain standpipe;

receive the signal from the pressure sensor while the drain pump flows the wash fluid from the tub to the drain standpipe;

determine a height of the drain standpipe based on the signal from the pressure sensor by calculating a rate of change in the signal from the pressure sensor over time while the drain pump flows the wash fluid from the tub to the drain standpipe; and adjust operation of the washing machine appliance in order to reduce soap sud formation within the tub in response to the determined height of the drain standpipe, and wherein the controller is configured to adjust the operation of the washing machine appliance in order to reduce soap sud formation within the tub by one or more of modifying detergent dosing of a bulk dispense system, extending a duration of an agitation cycle, extending a duration of an tumbling cycle, adjusting a temperature of the wash fluid within the tub, adding additional wash fluid into the tub, modifying a rotational speed and/or acceleration of the basket during a spin cycle, and conducting an additional rinse cycle.

6. The washing machine appliance of claim 5, wherein the determined height of the drain standpipe is proportional to the rate of change in the signal from the pressure sensor over time while the drain pump flows the wash fluid from the tub to the drain standpipe.

7. The washing machine appliance of claim 5, wherein the determined height of the drain standpipe is a normal drain height when a magnitude of the rate of change in the signal from the pressure sensor over time is greater than a threshold value, and the determined height of the drain standpipe is a high drain height when the magnitude of the rate of change in the signal from the pressure sensor over time is less than the threshold value.

8. The washing machine appliance of claim 7, wherein the controller is configured to adjust operation of the washing machine appliance by one or more of modifying a drain profile of the drain pump when the determined height of the drain standpipe is the high drain height.

9. The washing machine appliance of claim 8, wherein the normal drain height is about three feet, and the high drain height is no less than two feet greater than the normal drain height.

* * * * *